United States Patent [19]

Gebhardt

[11] Patent Number: 4,882,866

[45] Date of Patent: Nov. 28, 1989

[54] SIGNAGE SYSTEM SUPPORT STRUCTURE

[76] Inventor: Roland Gebhardt, 67 Vestry St., New York, N.Y. 10013

[21] Appl. No.: 941,595

[22] Filed: Dec. 15, 1986

[51] Int. Cl.[4] ..... G09F 7/02

[52] U.S. Cl. ..... 40/611; 40/617

[58] Field of Search ..... 40/618, 611, 16.4, 617, 40/649, 650

[56] References Cited

U.S. PATENT DOCUMENTS

| | | | |
|---|---|---|---|
| 3,154,870 | 11/1964 | Hopp et al. | 40/16.4 |
| 3,208,170 | 9/1965 | Madey | 40/618 |
| 3,555,715 | 1/1971 | Shell | 40/618 |
| 3,778,915 | 12/1973 | Freeman et al. | 40/618 |
| 3,877,163 | 4/1975 | Bissonet | 40/16.4 |

*Primary Examiner*—Robert Peshock
*Assistant Examiner*—Michael Lynch
*Attorney, Agent, or Firm*—Robert W. Fiddler

[57] ABSTRACT

A signage system support structure formed from a pair of identical preferably extruded multi-grooved channel members. A connecting element in the form of an elongate rigid panel inserted into an unconstricted medial groove of each channel serves to join two channels. Each channel is additionally formed with a constricted medial groove, a pair of outwardly facing grooves and a pair of lateral grooves on each side of and parallel to the medial grooves. In use the upper and/or lower edges of a sign to be supported are engaged in one or more of the channel grooves with a flat sign having either opposed edges encased in the lateral grooves or a free edge in the constricted medial groove, and an arcuate sign having its edges engaged in the outwardly facing grooves. The signs or supported displays may be formed with engaging tabs displaceable out of the plane of the sign to engage in a groove.

17 Claims, 1 Drawing Sheet

SIGNAGE SYSTEM SUPPORT STRUCTURE

This invention relates to the art of signage systems, and more particularly to a unique supporting structure for such signage systems facilitating the mounting and support for display of a variety of planar or arcuate in cross section sign elements or displays.

BACKGROUND OF THE INVENTION

A variety of sign structures, or signage systems have been evolved in the past for use in mounting a variety of different displays or signs. Differently countoured grooved channel members have been employed with the grooves of the channel member dimensioned to engage the edges of the signs or displays to be supported. Thus, Orlin in U.S. Pat. 2,640,288 discloses a price tag holder in which a channel member is provided with slots for holding price tags or the like. Feibelman in U.S. Pat. 3,958,788 discloses a display card holder formed of a channel member provided with grooves to releasably and slidably receive a display card. Greenberger in U.S. Pat. 4,453,324 discloses a pricing sign formed by a grooved channel member in which the grooves are formed with flanges adapted to overlie pricing signs.

Though channel members of the type disclosed by the above mentioned patents serve the purpose for which designed, they are limited to use with specifically dimensioned cards or displays, and the specific channels are limited to supporting a specifically sized price tag, display card or sign.

BRIEF SUMMARY OF THE INVENTION

It is with these considerations in mind that applicant has developed a sign supporting element which facilitates the formation of a myriad of different types and sizes of signs and displays utilizing a single size channel member.

It is accordingly among the primary objects of this invention to provide an improved sign support structure which may support a variety of differently shaped signs of different sizes, with differently contoured surfaces.

A further object of the invention is to provide a signage system support structure which may be economically and efficiently formed.

It is also an object of the invention provide a signage system support structure formed of members in which a member of one size may be combined with like members to form signs of a variety of different sizes.

Another object of the invention is to provide a signage system support structure which may either be hung or affixed to a wall.

An additional important object of the invention is to provide a stock member which may be combined with like members to form a variety of differently sized signage support structures.

These and other objects of the invention which will become hereafter apparent are attained by providing a preferably extruded multi-grooved channel member formed with a pair of outwardly facing grooves, two opposing medial grooves on either side of a web, and two lateral grooves, one on each side of and parallel to the medial grooves. In use, to form a sign support, a pair of channel members formed as described are arranged with a connecting element in the form of a board or the like positioned in one of the medial grooves of each channel, with the outwardly facing grooves extending from the free ends of the channel remote from the connecting member.

When the support structure is employed in forming a sign or display, a display card is arranged with the edges thereof in one or more of the channel grooves. Thus, a rounded in cross section display may be supported by arranging free opposed edges of the display in the outwardly facing grooves of the assembled support. A planar display may be supported either with two opposed edges of the display arranged in the lateral grooves of the assembly, or with one display edge engaged in a medial groove.

A feature of the invention resides in the fact that the sign supporting channel members may readily be formed of extruded nonferrous materials such as aluminum or zinc, or alloys thereof, or of a variety of plastics, facilitating efficient mass production.

Another feature of the invention is that a given extruded channel length may readily be cut to desired size to form a sign.

Another feature of the invention resides in the fact that the size of a given sign is determined by the size of the connecting member, and not by the size of the channel, so that a channel of uniform size may be inexpensively formed to be selectively combined to form signs of different sizes.

BRIEF DESCRIPTION OF THE DRAWING

The specific details of a preferred embodiment of the invention, and of the manner and process of making and using it will be described in such full, clear, and concise and exact terms as to enable those skilled in the art to make and use same in conjunction with the accompanying drawings wherein.

DETAILED DESCRIPTION

Figure 1:
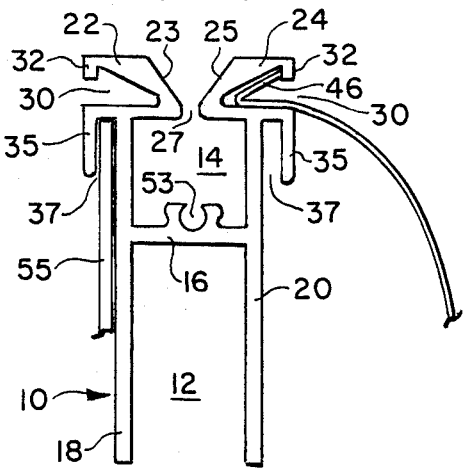
FIG. 1 is an end view of a channel member as employed in forming a signage system schematically showing a broken section of an arcuately supported sign and a planar sign in and elevations.

As illustrated in the drawings, where like numerals will be employed to designate like part, a multi-grooved channel member 10 is shown in end elevation, which as understood by those skilled in the art may be readily formed by extrusion or any conventionally available channel forming technique such as rolling, molding, or the like. The channel 10 is formed with an unconstricted open ended groove 12, and a constricted groove 14. Web 16 separates groove 12 from groove 14 extending between legs 18 and 20 of the channel 10.

Inwardly extending flanges 22 and 24 are arranged at the upper ends of channel legs 18 and 20, respectively, as viewed in FIG. 1, and are contoured as illustrated with sloping surfaces 23 and 25 on flanges 22 and 24 respectively terminating in opening 27 leading into constricted medial groove 14.

A fastener engaging groove 30 is formed on web 16 in constricted medial groove 14.

Flanges 22 and 24 are each formed with an outwardly facing groove 30 contoured as illustrated with an engaging lip 32 on the outer end of at least one wall of the outwardly facing groove 30.

A downwardly extending leg 35 spaced from channel legs 18 and 20 is provided on each side of the channel member 10 with the spacing between legs 35, and legs 18, 20 providing lateral grooves 37.

Figure 2:
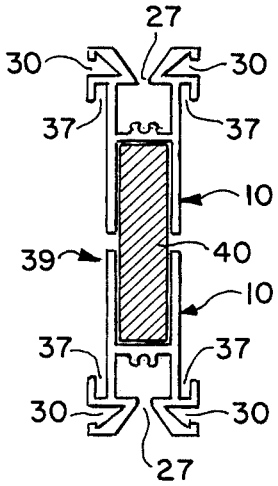
FIG. 2 is an end view of the channel member of FIG. 1 combined with a like channel member by a connecting element to form a signage system support structure.

In forming a signage system support structure 39 as shown in FIG. 2 utilizing a channel member 10 as described and illustrated in FIG. 1, a pair of such channel members 10 are arranged with open ended medial grooves 12 facing each other and joined together, as illustrated in FIG. 2, by means of a connecting element 40 in the form of an elongate rectangular in cross-section member which may readily be made of wood board, chipboard, or the like wood substitutes, plastic, or the like with the connecting element 40 dimensioned of a width and height as shown in FIG. 2 such as to permit a press fit into the open ended medial grooves 12 of the channel members 10 to be combined, and of a length preferably equal to the length of the sign to be formed. As will be apparent to those skilled in the art, the length of the connecting element 40 may be selected to be such as to provide the desired rigidity to the signage system support structure so that the connecting element 40 may be the full length of the sign to be formed, or may be formed of a plurality of spaced connecting elements 40 positioned in the open ended medial grooves 12.

OPERATION

In use, the channel members 12 are combined as above described in connection with FIG. 2 to form a signage system support structure 39 which may be combined with a variety of different sign or display elements. As above described, the channel members 10 may be formed utilizing a variety of conventionally available production techniques, it being preferred to form the channel members 10 of extruded nonferrous metals such as aluminum, zinc, or a variety of different nonferrous lightweight metal alloys, or plastics. The extruded channel members 10 are cut to desired length, and a pair of channel members are joined by means of connecting elements 40 as described in connection with FIG. 2. Connecting elements 40 may be formed of elongate strips of any relatively rigid material, wood, wood substitutes, or plastics being preferred.

After assembly, the signage system support structure as shown in FIG. 2 may be employed to form a variety of different signs or displays.

Figure 3:
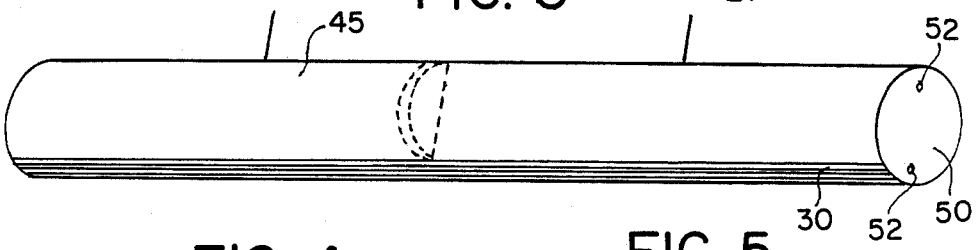
FIG. 3 is a perspective view of an arcuate in cross section display formed utilizing the signage support structure of FIG. 2.
Figure 4:
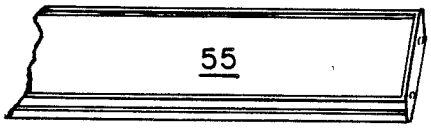
FIG. 4 is a perspective view of the end of a planar display formed using the signage support structure of FIG. 2.

In FIG. 3, arcuate in cross-section sign elements 45 are shown supported to form a rounded in cross-section sign. The arcuate elements 45, as best seen in FIG. 1, are formed with a return bend 46 preferably at the free edge of the arcuate element, with the return bend slid into outwardly facing grooves 30 of the channel member 10, with the return bend 46 of the sign element 45 engaging against lips 32. The ends of the formed sign may be closed by cover plates 50, as seen on the right in FIG. 3, with fastening elements 52 in the form of screws, press pins, or the like dimensioned to securely engage fastening element groove 53 in channel member 10.

Where a rectangular in cross-section display is desired, the support structure 39 as shown in FIG. 2 may have sign elements in the form of planar panels 55 of flat sheet material secured thereto, as best seen in FIGS. 1 and 4 by forming the panel 55 of a size to extend between the upper and lower lateral grooves 37 on one side of the support structure 39 shown in FIG. 2 so as to lie flat against channel member walls 18 or 20. Rectangular end caps 56 are secured as seen to the right of FIG. 4 to the end of the sign support structure 39 as shown in FIG. 2 by means of press pins, screws or the like engaged in fastener engaging groove 53.

Figure 5:
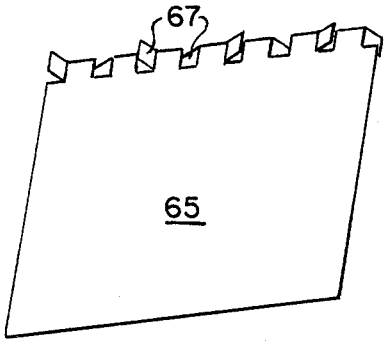
FIG. 5 is a planar sign of the type which may be combined with the signs of FIGS. 3 and 4 to form a depending sign.

Planar sign elements 65 of a type as best seen in FIG. 5, may be provided for securement to the sign support structure channel member 10 either as depending elements, or as elements supported form below, as will be apparent to those skilled in the art. Sign element 65 is preferably formed of sheet material provided with tabs 67 displaceable from the plane of sign 65. A sign 65 may be supported on the support structure by inserting the tabbed edge of the sign 65 in constricted medial groove 14 with tabs 67 engaged between flanges 22 and 24, either at the top or at the bottom of the assembled structure shown in FIG. 2.

Figure 6:
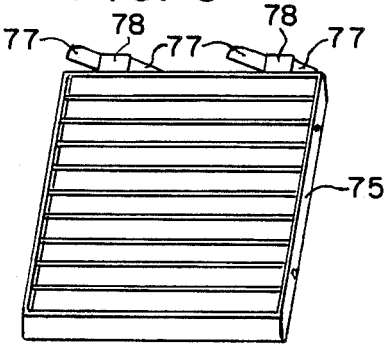
FIG. 6 shows a suggested depending sign element which may be supported from the signage support structure of FIG. 2.

A variant of a depending sign element is shown in FIG. 6 in which a sign frame 75 provided with tabs 77 extending from flange 78 on one end of the frame 75 is secured preferably to a lower edge of support structure 39 by sliding the sign flange 78 with its tabs 77 into downwardly facing constricted groove 14.

Figure 7:
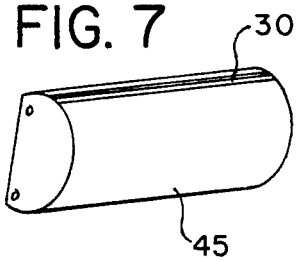
FIG. 7 is a perspective view of a semicircular in cross section display adapted for wall mounting employing the signage support structure of FIG. 2.

The supporting structure 39 as shown in FIG. 2 may either be hung as shown in FIG. 3, or secured to a wall as shown in FIG. 7 utilizing conventional supporting techniques.

The above disclosure has been given by way of illustration and elucidation, and not by way of limitation, and it is desired to protect all embodiments of the herein disclosed inventive concept within the scope of the appended claims.

What is claimed is:

1. A signage system suport structure comprising a pair of multigrooved channel members, each channel member having a pair of spaced parallel legs joined by a web to form oppositely facing medial grooves, which in conventional usage of the support structure will face upwardly and downwardly; an inwardly extending flange secured at one end of each of said legs to constrict one of said medial grooves; a lateral groove on at least one side of said medial grooves on each channel member, said lateral groove formed on the same side of each channel member when joined into said support structure; an outwardly facing groove in each flange; and a connecting element positioned to extend between said channel members and arranged within a medial groove of each connected channel member.

2. A signage system support structure as in claim 1 in which one of the grooves of each pair of medial grooves is constricted, and one groove is unconstricted with said connecting element positioned in the unconstricted medial groove of each channel member.

3. A signage support system as in claim 1 in which an engaging lip is formed at an outer end of said outwardly facing groove.

4. A signage system employing a support structure as in claim 3 in which an arcuately contoured sign element having opposed edges each formed with a bent edge is supported by inserting the bent edge in the outwardly extending groove for engagement by said lip.

5. A signage system support structure as in claim 1 in which said groove on at least one side of said medial grooves is lateral of and extends in a plane parallel to the plane of said medial grooves.

6. A signage support system as in claim 5 in which a leg is spaced from said medial grooves to form said lateral groove.

7. A signage support structure as in claim 1 in which said connecting element is of an elongate planar rectangular in cross-section shape dimensioned to substantially occupy the opposed unconstricted grooves of a pair of channel members arranged to form the support structure.

8. A signage system employing a support structure as in claim 1 in which a sign element having opposed edges is mounted on said support structure by positioning the opposed edges of the sign element one edge in a groove on at least one side of said medial grooves in each channel member constituting said support structure.

9. A signage system employing a support structure as in claim 1 in which a sign element having an edge is supported by inserting the sign element edge in said constricted medial groove.

10. A signage system as in claim 9 in which said sign element is flat and is formed with tabs displaceable from the plane of said sign element in said constricted medial groove.

11. A signage system as in claim 9 in which the ends of said signage system are formed by a cover plate secured to an end of said support structure by a fastening member extending into a fastener engaging groove in said channel member.

12. A signage system employing a support structure as in claim 1 in which an arcuately contoured sign element having opposed edges is supported by inserting the opposed edges of the sign element one edge in an outwardly facing groove on one channel member and the other sign element edge in the outwardly facing groove on the other channel member.

13. A signage system as in claim 12 in which the opposed sign element edges are formed with a reverse bend engaged in said outwardly facing grooves.

14. A signage system employing a support structure as in claim 1 in which two arcuately contoured signs each having opposed edges is secured on opposite sides of said channel members by securing the opposed edges of each of said signs in said outwardly facing grooves on said channel member to form a round in cross-section sign display.

15. A channel member for use informing a signage system support structure, said channel member comprising a pair of spaced legs joined by a web to form oppositely facing medial grooves; an inwardly extending flange secured at one end of each said legs to constrict one of said medial grooves, the flange on one end spaced from the other to provide access to the medial groove; an outwardly facing groove in each flange; a lateral groove on opposed sides of said medial grooves, said lateral groove opening toward an end of said channel member opposite said flanges.

16. A channel member as in claim 15 having a lip at the end of said flange extending into the opening of said outwardly facing groove.

17. A channel member as in claim 15 having a fastener engaging groove on said web.

* * * * *